US006883484B2

(12) United States Patent
Oka et al.

(10) Patent No.: US 6,883,484 B2
(45) Date of Patent: Apr. 26, 2005

(54) ROCKER SHAFT

(75) Inventors: Toshihiko Oka, Anjyo (JP); Masanori Tokuhisa, Rittou (JP); Norio Takayasu, Kyoto (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/864,372

(22) Filed: Jun. 10, 2004

(65) Prior Publication Data

US 2005/0016484 A1 Jan. 27, 2005

(30) Foreign Application Priority Data

Jun. 12, 2003 (JP) ..... 2003-167285

(51) Int. Cl.[7] ..... F01L 1/18
(52) U.S. Cl. ..... 123/90.39; 123/90.36; 123/90.33; 123/90.34
(58) Field of Search ..... 123/90.36, 90.39

(56) References Cited

U.S. PATENT DOCUMENTS 4,537,166 A * 8/1985 Kimura et al. ..... 123/90.36
5,125,373 A * 6/1992 Yamada et al. ..... 123/90.36
6,718,940 B1 * 4/2004 Usko ..... 123/322
6,810,846 B1 * 11/2004 Murata et al. ..... 123/90.36

* cited by examiner

*Primary Examiner*—Edward K. Look
*Assistant Examiner*—Kyle M. Riddle
(74) *Attorney, Agent, or Firm*—Birch, Stewart, Kolasch & Birch, LLP

(57) ABSTRACT

A plurality of oil passages are formed in a shaft body of a rocker shaft, which partially constitutes a valve drive system of an internal combustion engine. A bolt hole is formed in the shaft body in such a manner as to substantially perpendicularly intersect the axis of the shaft body. A bush is fitted into the bolt hole in such a manner as to prevent the bolt hole from establishing communication between the plurality of oil passages. A bolt is fastened through the bush to thereby fix the rocker shaft on a cylinder head. This structure improves the support rigidity of the rocker shaft and the dynamic characteristics of the valve drive system, and reduces the number of components and the number of working man-hours.

8 Claims, 6 Drawing Sheets

ROCKER SHAFT

BACKGROUND OF THE INVENTION

CROSS REFERENCES TO RELATED APPLICATION

This non-provisional application incorporates by reference the subject matter of Application No. 2003-167285 filed in Japan on Jun. 12, 2003, on which a priority claim is based under 35 U.S.C. § 119(a).

1. Field of the Invention

The present invention relates to a rocker shaft that partially constitutes a valve drive system of an internal combustion engine.

2. Description of the Related Art

An oil passage for supply of lubricating oil is formed in a rocker shaft of a vehicle engine. The oil passage is used to supply lubricating oil to rotating or sliding components, such as pistons and cylinders.

An engine has a valve that is opened/closed to enable/disable communication between a combustion chamber and an intake passage, and a valve that is opened/closed to enable/disable communication between the combustion chamber and an exhaust passage. As the engine speed increases, gas flowing through the intake or exhaust passage begins to exhibit inertia, which is a characteristic of a fluid. Thus, opening/closing of the valves must be controlled such that, as the engine speed increases, a time during which the valves are opened increases. Therefore, the intake valve is opened before the exhaust valve is closed. In order to change, between high-speed operation and low-speed operation of the engine, a time during which the valves are opened/closed, a variable valve timing system for hydraulically controlling the valves is provided. An oil passage for allowing supply of oil used to perform the control is formed in the rocker shaft.

Thus, two oil passages; i.e., a passage for lubricating oil and a passage for control oil used in the variable valve timing system, are formed in the rocker shaft. The two oil passages must be formed along the axial direction of the rocker shaft.

Such a rocker shaft is generally mounted on an upper portion of a cylinder head by use of a holder, and bolts extending through corresponding holes that are formed in the rocker shaft. Such a rocker shaft is disclosed in, for example, Japanese Patent Application Laid-Open (kokai) No. 8-150412. FIG. 6 shows the disclosed rocker shaft.

A rocker shaft 101 includes an inner tube 102 and a cylindrical outer tube 103. A first space (oil passage) 104 is formed in the interior of the inner tube 102; and a second space (oil passage) 105 is formed between a trough 106 of the inner tube 102 and the inner circumferential surface of the outer tube 103, whereby the first space (oil passage) 104 and the second space (oil passage) 105 form two oil passages. A bolt hole 107 is formed in the rocker shaft 101.

The bolt hole 107, into which a bolt 108 is inserted, is provided offset from a center Or of the cross section of the rocker shaft 101. In FIG. 6, reference letter Ob denotes a center line of the bolt hole 107. The center line of the bolt hole 107 is offset from the center Or of the cross section of the rocker shaft 101 in order to prevent communication between the two oil passages 104 and 105 formed in the rocker shaft 101, thereby preventing oil leakage.

However, since the center line of the bolt hole 107 is offset from the center Or of the rocker shaft 101, when only the bolt 108 is used to fix the rocker shaft 101, sufficient support rigidity may fail to be provided. In such a case, a holder 110 shown in FIG. 6 must be mounted on an upper portion of a cylinder head 109 so as to enhance support rigidity. However, use of the holder 110 results in an increase in cost.

SUMMARY OF THE INVENTION

An object of the present invention is to solve the above-mentioned problems and to provide a rocker shaft whose support rigidity is enhanced to thereby enhance the dynamic characteristics of a valve drive system and whose number of components and number of working man-hours in relation to production are reduced to thereby reduce cost.

To achieve the above object, the present invention provides an improved rocker shaft, which partially constitutes a valve drive system of an internal combustion engine. A plurality of oil passages are formed in a shaft body which constitutes a main portion of the rocker shaft, such that the oil passages extend along an axial direction of the shaft body. A bolt hole is formed in the shaft body in such a manner as to substantially perpendicularly intersect a center line of the shaft body, and establishes communication between the plurality of oil passages. A bush is fitted into the bolt hole so as to prevent the bolt hole from establishing communication between the plurality of oil passages.

DETAILED DESCRIPTION OF THE PREFERRED EMBODIMENTS

Figure 3B:
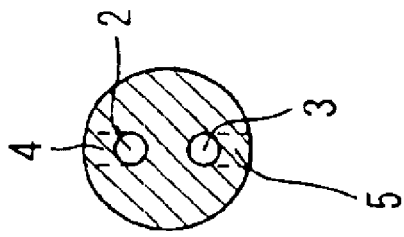
FIG. 3B is a cross-sectional view of the shaft body of FIG. 3A.
Figure 3A:
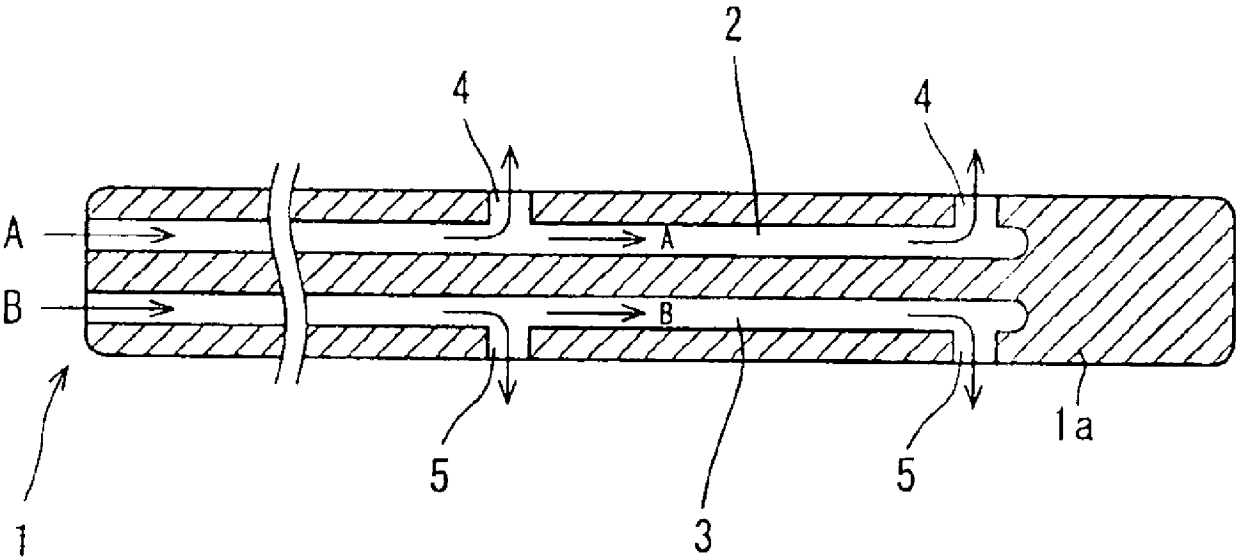
FIG. 3A is a longitudinal sectional view of the shaft body of the rocker shaft.

Embodiments of the present invention will next be described in detail with reference to the drawings. FIGS. 3A and 3B schematically show the structure of a shaft body of a rocker shaft to which the present invention is applied. FIG. 3A is a longitudinal sectional view of the shaft body; and FIG. 3B is a cross-sectional view of the shaft body. A lubricating oil passage 2 for supply of lubricating oil and a control oil passage 3 for supplying control oil to a variable valve timing system are formed in a shaft body 1*a* of a rocker shaft 1. The lubricating oil passage 2 extends axially in the shaft body 1*a* and is adapted to supply lubricating oil to sliding or rotating components of a vehicle engine. The control oil passage 3 is adapted to supply control oil to the variable valve timing system in order to hydraulically control valves (not shown) used to open/close combustion chambers.

The lubricating oil passage 2 and the control oil passage 3 are formed in the shaft body 1*a* in such a manner as to extend along the axial direction of the rocker shaft 1. Lubricating oil discharge passages 4 and control oil discharge passages 5, which communicate with the exterior of the rocker shaft 1, are connected to the lubricating oil passage 2 and the control oil passage 3, respectively. The lubricating oil discharge passages 4 and the control oil discharge passages 5 are formed in the shaft body 1*a* in such a manner as to extend in radial directions of the rocker shaft 1 (in FIG. 3A, reference letter A denotes the flow of lubricating oil, and reference letter B denotes the flow of control oil).

Figure 1:
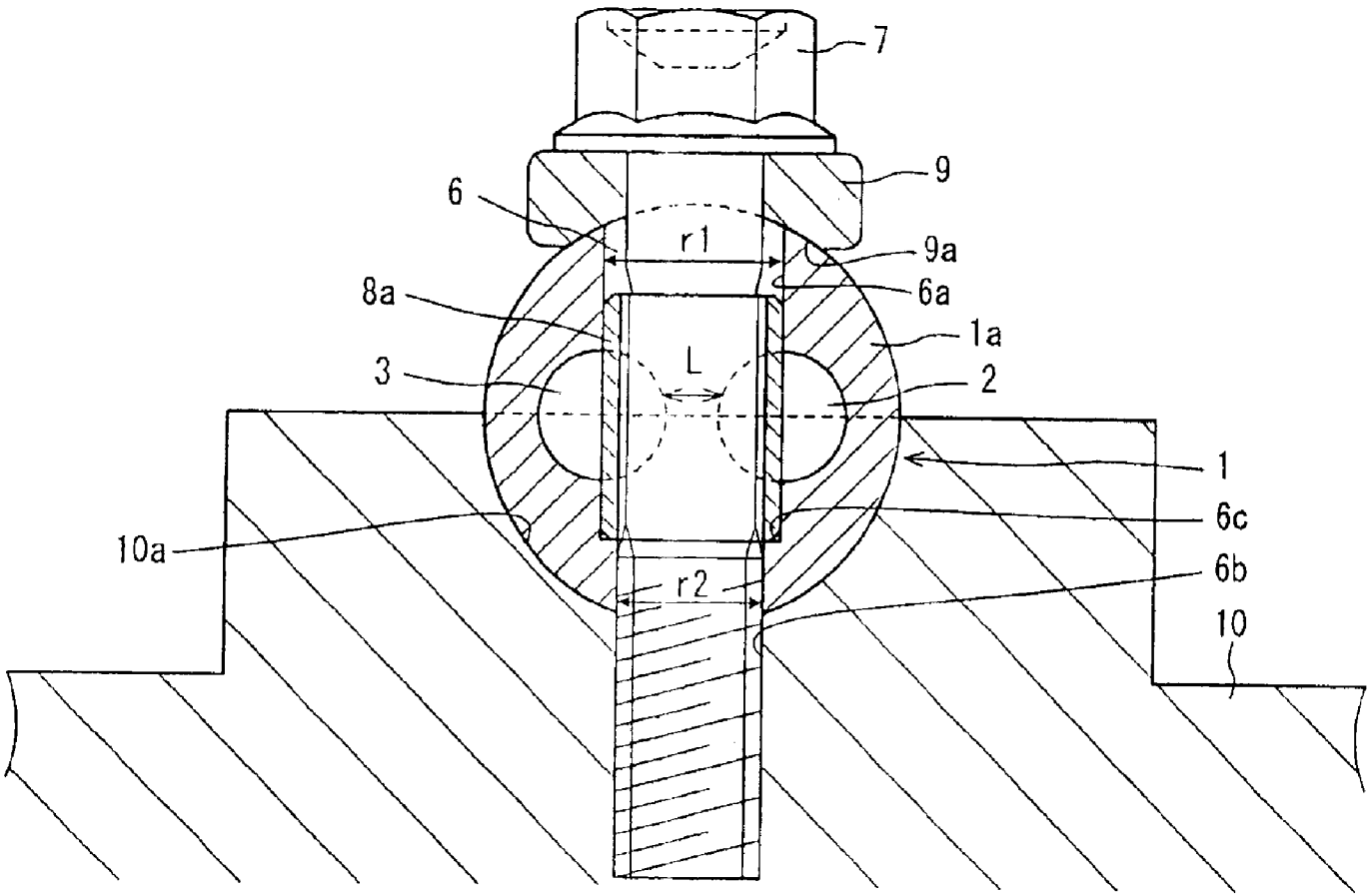
FIG. 1 is a sectional view of a rocker shaft according to an embodiment of the present invention.
Figure 2:
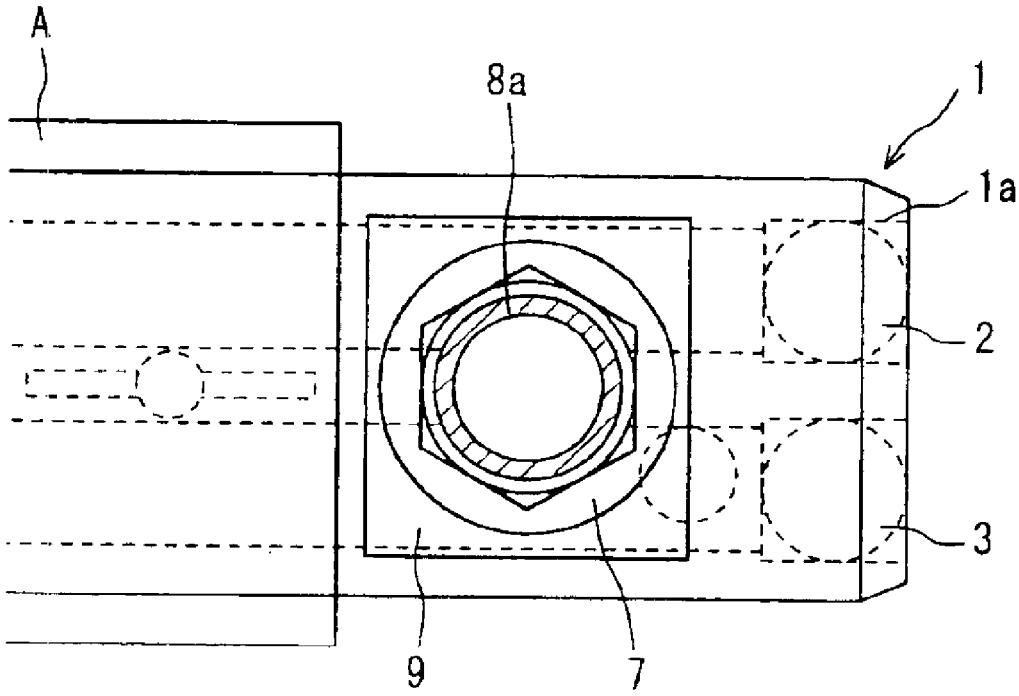
FIG. 2 is a partial plan view of the rocker shaft of FIG. 1.

FIGS. 1 and 2 schematically show the structure of a rocker shaft according to an embodiment of the present invention. A bolt hole 6 is formed in the shaft body 1*a* in such a manner as to pass through the center of the cross section of the shaft body 1*a*. In other words, in the rocker shaft 1, the center line of the bolt hole 6 coincides with a center line of the cross section of the shaft body 1*a*.

The bolt hole 6 partially crosses the two oil passages 2 and 3, thereby substantially establishing communication between the two oil passages 2 and 3. The bolt hole 6 consists of a hole 6*a* and a hole 6*b*. The hole 6*a* accounts for most of the bolt hole 6 and has a diameter r1; and the hole 6*b* extends downward from the lower end of the hole 6*a* and has a diameter r2 slightly smaller than the diameter r1. In other words, the bolt hole 6 assumes the form of a stepped hole. In FIG. 1, reference numeral 6*c* denotes a step portion. In FIG. 2, reference letter A denotes a rocker arm mounting portion.

A cylindrical bush 8*a* is lightly press-fitted into the bolt hole 6. The expression "to be lightly press-fitted" means to be press-fitted under such a low pressure as not to cause deformation of the rocker shaft 1. The lower end of the cylindrical bush 8*a* abuts the step portion 6*c*, whereby the cylindrical bush 8*a* is positioned.

Next, the shaft body 1*a* into which the cylindrical bush 8*a* has been lightly press-fitted is placed in a depression 10*a*, which is provided on a cylinder head 10 and has an arcuate shape similar to that of the shaft body 1*a*. Then, a washer 9 is placed on the shaft body 1*a*. The washer 9 has a depression 9*a*, which has an arcuate shape similar to that of the shaft body 1*a*. The washer 9 is placed on the shaft body 1*a* in such a manner that the depression 9*a* abuts the shaft body 1*a*. A bolt 7 is fastened to thereby fix the shaft body 1*a* on the cylinder head 10 via the washer 9. The washer 9 has a rectangular shape so as to provide a wider area of contact with the shaft body 1*a* as compared with a circular washer, and thus can be stably mounted on the shaft body 1*a*. A hole portion of the washer 9 and an internal-thread portion of the cylinder head 10 are prepared beforehand. The shaft body 1*a* is fixed on the cylinder head 10 at a plurality of positions by use of the bolts 7.

Since each of the bolt holes 6 is formed in the shaft body 1*a* in such a manner as to pass through the center of the cross section of the shaft body 1*a*, rigidity is enhanced in terms of support of rocker arms on the rocker shaft 1 as compared with the case where the bolt hole 6 is formed offset from the center. The cylindrical bush 8*a* lightly press-fitted into the bolt hole 6 provides enhanced sealing against the shaft body 1*a*, prevents communication between the lubricating oil passage 2 and the control oil passage 3, and prevents leakage of lubricating oil and control oil.

Figure 4A:
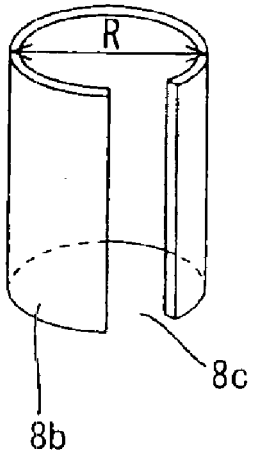
FIG. 4A is a perspective view of a bush having a C-shaped transverse cross section and used in a rocker shaft according to another embodiment of the present invention.
Figure 4B:
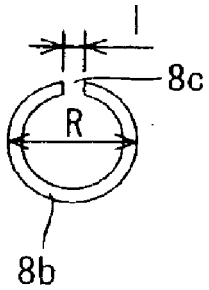
FIG. 4B is a cross-sectional view of the bush of FIG. 4A.
Figure 4C:
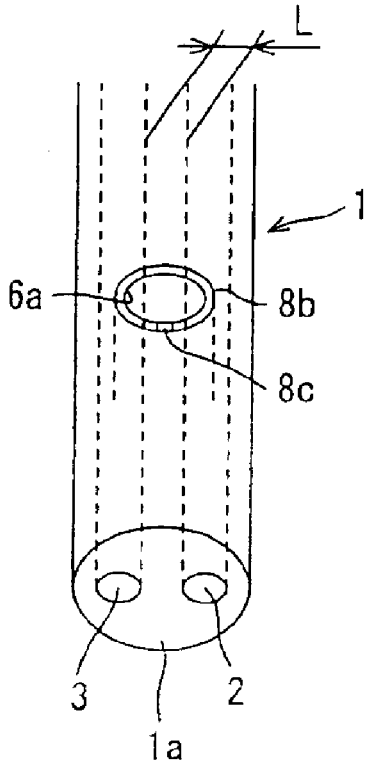
FIG. 4C is a schematic view of the shaft body of the rocker shaft in which the bush of FIG. 4A is fitted.
Figure 5:
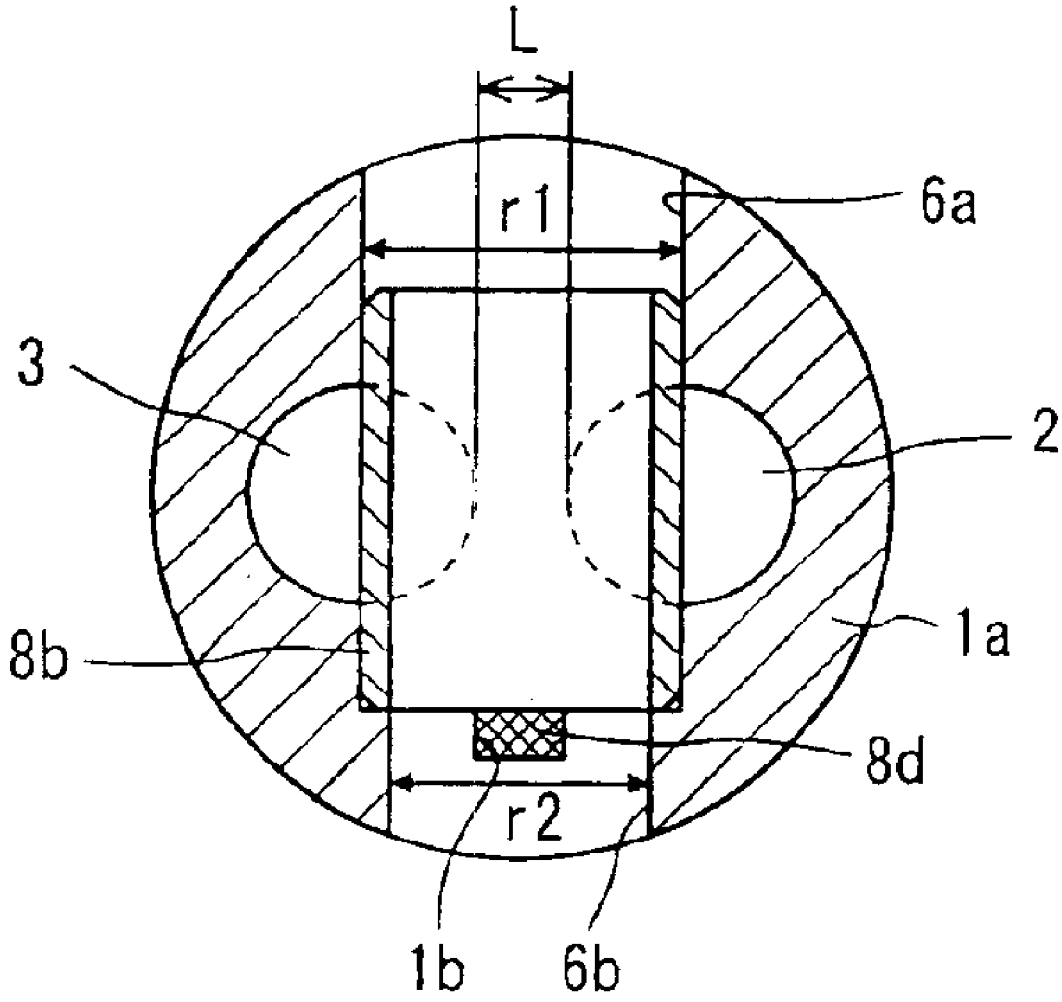
FIG. 5 is a sectional view of a rocker shaft according to still another embodiment of the present invention and in which a bush having a C-shaped transverse cross section is fitted.
Figure 6:
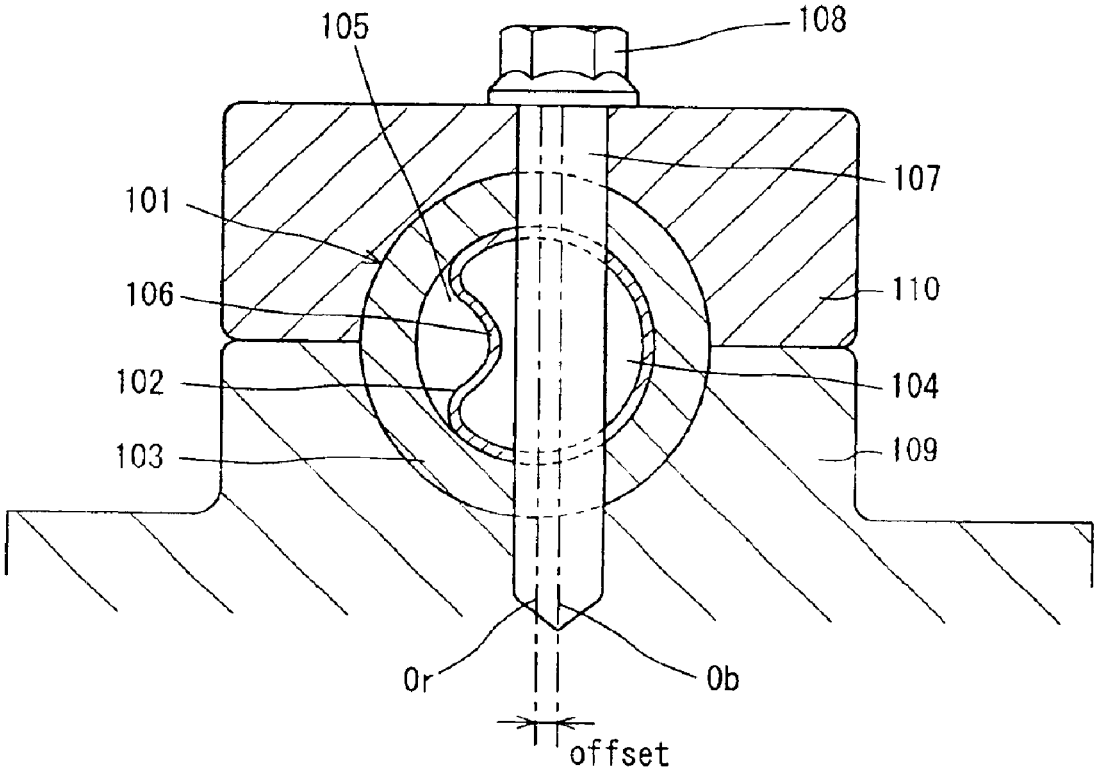
FIG. 6 is a sectional view showing a conventional rocker shaft.

FIGS. 4A to 4C shows another embodiment of the present invention. FIG. 4A is a perspective view of a bush 8*b* having a C-shaped transverse cross section; FIG. 4B is a cross-sectional view of the bush 8*b*; and FIG. 4C is a schematic view of a shaft body in which the bush 8*b* is fitted. FIG. 5 shows still another embodiment of the present invention. FIG. 5 is a sectional view of a rocker shaft in which the bush 8*b* having a C-shaped transverse cross section is fitted.

As shown in these drawings, the bush 8*b* has a cutout 8*c* to thereby assume a C-shaped transverse cross section. The bush 8*b* is inserted into the bolt hole 6 while being deformed so as to reduce its diameter R, until the bush 8*b* reaches the step portion 6*c*, which serves as a positioning portion. In insertion of the bush 8*b*, the bush 8*b* is deformed to thereby reduce the load which is imposed on the shaft body 1*a* in the course of insertion of the bush 8*b*, so that deformation of the shaft body 1*a* can be suppressed.

Preferably, before insertion of the bush 8*b*, R>r1 and 1<L or 1=L, where R is the diameter of the bush 8*b*; r1 is the diameter of the hole 6*a*; l is the width of the cutout 8*c*; and L is the distance between the lubricating oil passage 2 and the control oil passage 3, which are formed in the shaft body 1*a*.

FIG. 5 shows the bush 8*b* having a C-shaped transverse cross section and which further has a positioning projection 8*d*. The positioning projection 8*d* (hatched in FIG. 5) is a portion projecting from the lower end of the bush 8*b*, which abuts the step portion 6*c* of the bolt hole 6. In order to mate with the projection 8*d*, a groove 1*b* is formed on the step portion 6*c*. When the bush 8*b* is inserted into the bolt hole 6, the lower end of the bush 8*b* abuts the step portion 6*c*, and the positioning projection 8*d* is fitted into the groove 1*b*, whereby the bush 8*b* is reliably positioned in longitudinal and circumferential directions. Since the cutout 8*c* is located between the two oil passages 2 and 3, reliable sealing is attained.

In order to facilitate the operation of lightly press-fitting the cylindrical bush 8*a* or the bush 8*b* having a C-shaped transverse cross section into the bolt hole 6, lubricative coating may be applied to the bushes 8*a* and 8*b*. Also, the bushes 8*a* and 8*b* may be formed of aluminum, resin, or the like such that the bushes 8*a* and 8*b* have a small wall thickness in order to suppress deformation of the shaft body 1*a* produced in the course of insertion of the bush 8*a* or 8*b*. Since the bushes 8*a* and 8*b* themselves have reduced rigidities, the fitting or insertion force can be reduced, whereby deformation of the shaft body 1*a* in the course of insertion of the bush 8*a* or 8*b* can be reduced further.

In the thus-configured rocker shaft of the present invention, the bolt hole is formed in the shaft body in such a manner as to substantially perpendicularly intersect the center line of the shaft body, and the cylindrical bush is fitted into the bolt hole in such a manner as to disable the bolt hole from establishing communication between a plurality of oil passages. Thus, the cylindrical bush and the shaft body of the rocker shaft are reliably sealed against each other, thereby preventing communication between the lubricating oil passage and the control oil passage as well as preventing leakage of lubricating oil and control oil.

Since the bolt hole is formed in the shaft body of the rocker shaft in such a manner as to pass through the center of the cross section of the shaft body, support rigidity is enhanced as compared with the case where the bolt hole is formed offset from the center. Furthermore, since the rocker shaft can be fixed without use of a holder, the number of components and the number of working man-hours in relation to production are reduced, thereby reducing cost.

In the rocker shaft of the present invention, employment of a C-shaped transverse cross section for the bush facilitates deformation of the bush, so that load that is imposed on the shaft body of the rocker shaft in the course of insertion of the bush drops, thereby suppressing deformation of the shaft body which could otherwise result from the insertion. Furthermore, use of aluminum or resin to form the bush and a reduction of the wall thickness of the bush lower rigidity of the bush itself, thereby lowering a force that is applied to the bush in the course of insertion of the bush. Also, application of lubricative coating to the bush facilitates light press-fitting. In this manner, reliability can be further increased in terms of suppression of deformation of the shaft body of the rocker shaft at the time of press-fitting the bush, whereby rigidity can be enhanced in terms of support of rocker arms, thereby providing improved performance of a valve drive system. Since the lubricating oil passage and the control oil passage do not communicate with each other, leakage of lubricating oil and control oil does not occur.

What is claimed is:

1. A rocker shaft, which partially constitutes a valve drive system of an internal combustion engine, comprising:

a shaft body which constitutes a main portion of said rocker shaft;

a plurality of oil passages formed in said shaft body and extending along an axial direction of said shaft body;

a bolt hole formed in said shaft body in such a manner as to substantially perpendicularly intersect a center line of said shaft body, and establishing communication between said plurality of oil passages; and a bush fitted into said bolt hole and preventing said bolt hole from establishing communication between said plurality of oil passages.

2. A rocker shaft according to claim 1, wherein the number of said oil passages is two, and said bolt hole is formed in such a manner as to partially cross said two oil passages, to thereby establish communication between said two oil passages.

3. A rocker shaft according to claim 2, wherein said bush assumes a substantially cylindrical shape and a transverse cross section shaped like the letter C.

4. A rocker shaft according to claim 2, wherein said bush is lightly press-fitted into said bolt hole.

5. A rocker shaft according to claim 2, wherein said bolt hole is a stepped hole having two different diameters, and said bush rests on a step portion of the stepped hole to thereby be positioned.

6. A rocker shaft according to claim 4, wherein said bush is formed of aluminum and is thin-walled.

7. A rocker shaft according to claim 2, wherein said bush is coated.

8. A rocker shaft according to claim 2, wherein said bush is formed of resin and is thin-walled.

* * * * *